US010039956B1

(12) United States Patent
Lin

(10) Patent No.: US 10,039,956 B1
(45) Date of Patent: Aug. 7, 2018

(54) STILTS

(71) Applicant: Joe Lin, Missouri City, TX (US)

(72) Inventor: Joe Lin, Missouri City, TX (US)

( * ) Notice: Subject to any disclaimer, the term of this patent is extended or adjusted under 35 U.S.C. 154(b) by 41 days.

(21) Appl. No.: 14/991,486

(22) Filed: Jan. 8, 2016

(51) Int. Cl.
*A63B 25/00* (2006.01)

(52) U.S. Cl.
CPC ..... *A63B 25/00* (2013.01)

(58) Field of Classification Search
CPC ..... A63B 25/00; A63B 25/02; A63B 25/04; A63B 25/06; A63B 25/08; A63B 25/10
See application file for complete search history.

(56) References Cited

U.S. PATENT DOCUMENTS 3,102,272 A * 9/1963 Emmert ..... A63B 25/00 482/75
5,645,515 A 7/1997 Armstrong et al.
2002/0077704 A1* 6/2002 Lin ..... A63B 25/00 623/28
2006/0217241 A1* 9/2006 Novara ..... A63B 25/00 482/75
2008/0096732 A1 4/2008 Lin et al.

* cited by examiner

*Primary Examiner* — Loan H Thanh
*Assistant Examiner* — Rae Fischer
(74) *Attorney, Agent, or Firm* — John R Casperson

(57) ABSTRACT

A stilt comprises a floor platform, a shoe platform, parallel supports extending between the platforms, a leg support extending above the shoe platform, and a yoke connecting the leg support to the shoe platform. The pair of parallel supports is substantially vertically mounted supports pivotally connecting the floor platform and the shoe platform. The vertical supports are spring-biased so as to maintain the vertical supports and the platforms in a parallelogram configuration. The leg support is mounted to one of the vertically mounted supports and to the shoe platform. The mounting includes a capturing bracket for engaging the lower end of the leg support. The yoke engages the leg support at the attachment to the shoe platform. A key closely engages depressions in the yoke and the leg support to resist twisting of the leg support.

6 Claims, 3 Drawing Sheets

STILTS

FIELD OF THE INVENTION

In one aspect, this invention relates to improved lower leg braces for stilts, particularly stilts employed in the construction industry to facilitate overhead work, such as accessing and hanging suspended ceiling structures or overhead electrical or duct work, or hanging or finishing drywall. In another aspect, this invention relates to providing such stilts with more reliable height adjustment features.

BACKGROUND OF THE INVENTION

U.S. Pat. No. 5,645,515, the disclosure of which is incorporated by reference herein, is an example of one type of spring-loaded parallelogram stilt employed by the construction industry. It utilizes a telescoping single upright post extending above the shoe platform and having a calf brace near the upper end to provide stability to the user. The telescoping post is necessary to provide adjustments to accommodate different users. However, it is prone to twisting over time. A structure to prevent the upright pole from twisting would be desirable.

Also, the vertical telescoping support members in the parallelogram legs are retained by single wing headed bolts which may become dislodged, leading to failure of the stilt and possible injury to the user. Greater reliability in the area would be desirable.

OBJECTS OF THE INVENTION

An object of the invention is to provide improvements to stilts that overcome the above noted deficiencies.

SUMMARY OF THE INVENTION

One embodiment of the invention relates to a stilt comprising a floor platform, a shoe platform, parallel supports extending between the platforms, a leg support extending above the shoe platform, and a yoke connecting the leg support to the shoe platform. The pair of parallel supports is substantially vertically mounted and pivotally connects the floor platform to the shoe platform. The vertical supports are spring-biased so as to maintain the vertical supports and the platforms in a parallelogram configuration. The leg support is mounted to one of the vertically mounted supports and to the shoe platform. The mounting includes a capturing bracket for engaging the lower end of the leg support. The yoke engages the leg support at the attachment to the shoe platform. In such a stilt, the improvement comprises a key closely engaging depressions in the yoke and/or the leg support to resist twisting of the leg support.

Another embodiment of the invention relates to a stilt comprising a floor platform, a shoe platform, and parallel supports extending between the platforms. The pair of parallel supports is substantially vertically mounted and pivotally connects the floor platform to the shoe platform. The vertical supports are spring-biased so as to maintain the vertical supports and the platforms in a parallelogram configuration. Each of the vertical supports is telescoping and is fixed in height by a bolt or pin positioned through a set of adjustment holes formed in each of the supports. In such a stilt, the improvement comprises a second bolt or pin positioned through a second set of adjustment holes formed in each of the supports. Failure or loss of one bolt or pin will not lead to collapse of the stilt if the other bolt or pin remains in place.

DETAILED DESCRIPTION OF THE INVENTION

Figure 1:
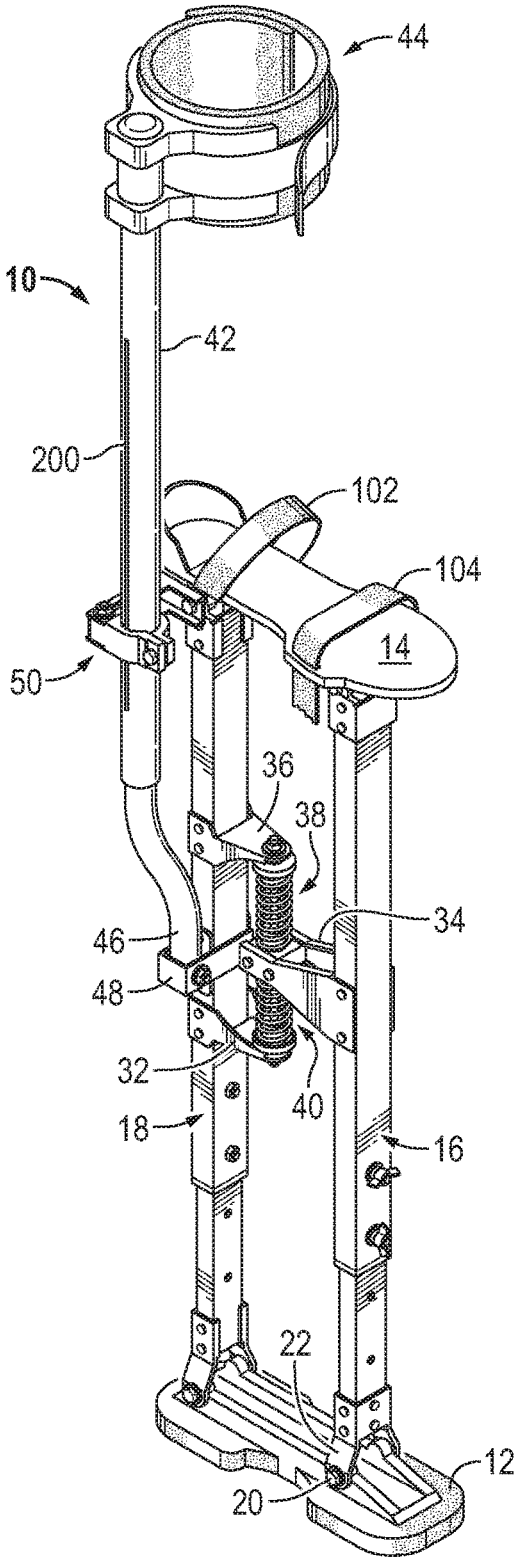
FIG. 1 is a pictorial illustration of a stilt according to an embodiment of the invention.
Figure 3:
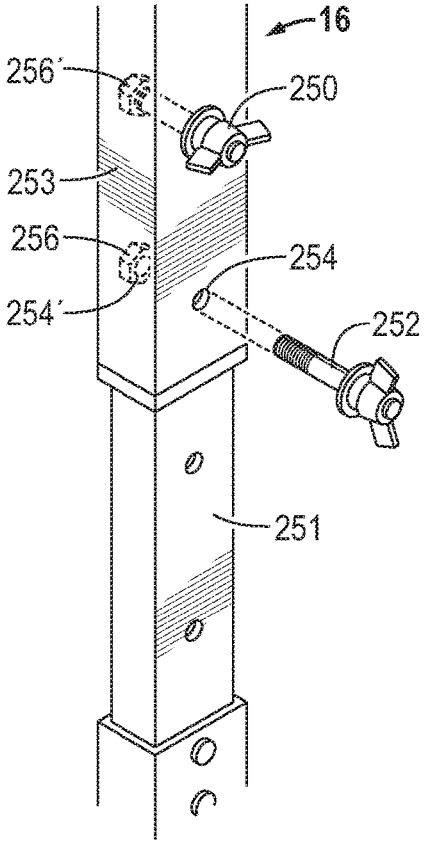
FIG. 3 is an enlarged illustration of another portion of FIG. 1.
Figure 2:
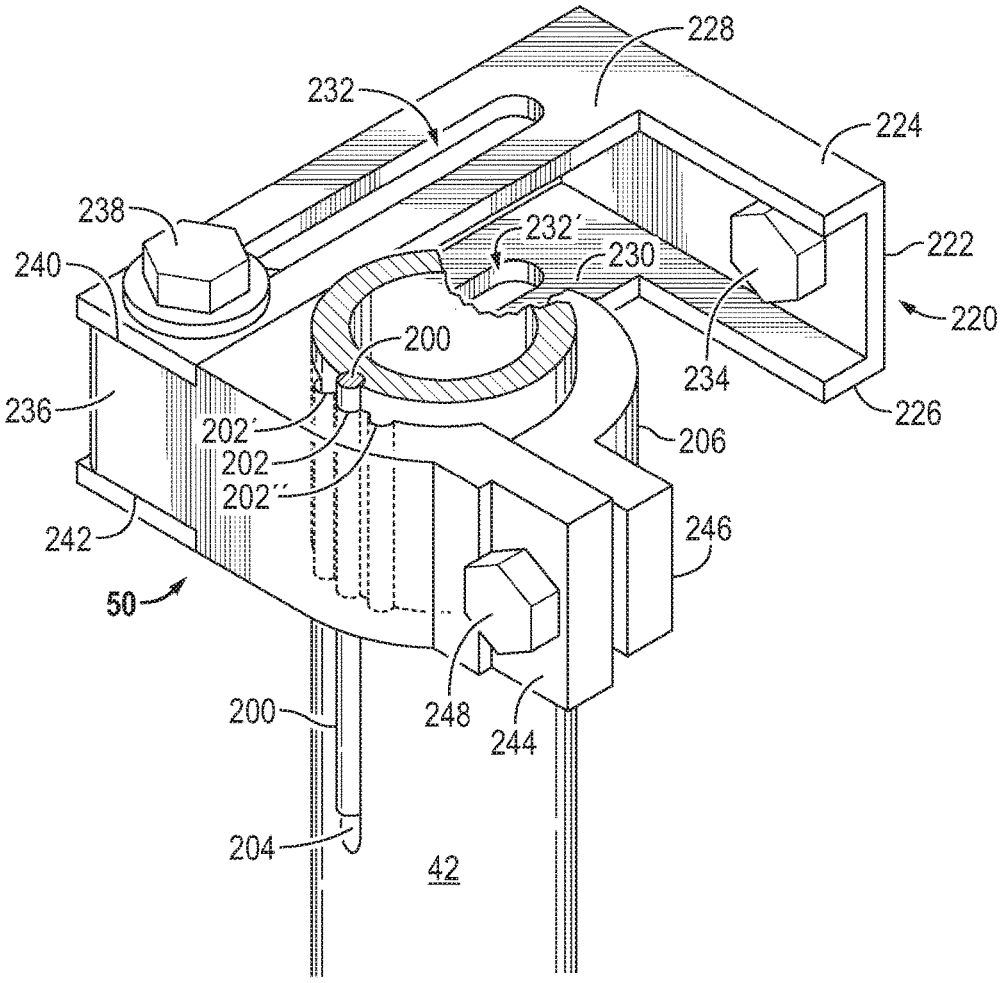
FIG. 2 is an enlarged illustration of a portion of FIG. 1.
Figure 4:
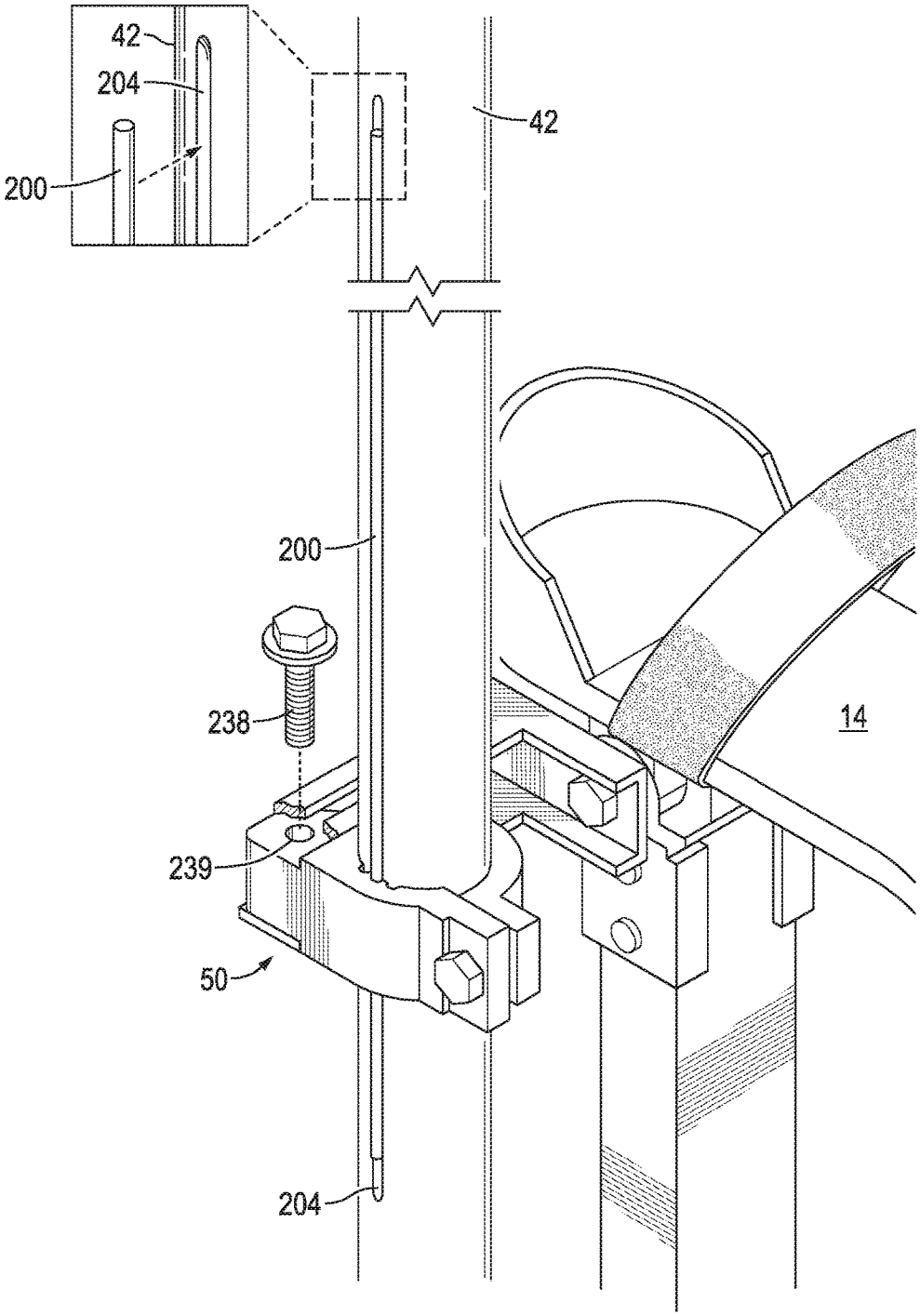
FIG. 4 is an enlarged illustration of a portion of FIG. 1 with a portion exploded out and another broken away to show an underlying detail and also a break-out window showing further detail of a another portion of the stilt.

FIG. 1 shows an improved stilt 10, in accordance with an embodiment of the present invention. The stilt 10 is of an adjustable parallelogram type known in the art. The stilt is comprised of a floor platform 12, a shoe platform 14, forward vertical support member 16 and rearward vertical support member 18. Forward vertical support member 16 is pivotally attached to floor platform 12 by a pin or bolt 20 fastened through bracket 22. Similar arrangements of a pin or bolt and brackets are provided to pivotally attach the rearward vertical support member to the floor platform, as well as to pivotally attached the forward and rearward vertical support members to the shoe platform.

Spring supports 32, 34 and 36 capture springs 38, 40, which provide spring biasing of the two vertical support members 16, 18 toward a rectangular configuration in combination with the shoe platform and floor platform. Hollow tubular leg support 42 having calf brace 44 is attached at its lower end 46 to rearward vertical support 18 by capturing bracket 48. Leg support 42 is attached to shoe platform 14 by yoke 50. Ankle strap 102 is attached to the rear of shoe platform 14. Toe strap 104 is attached at the front of shoe platform 14. The straps are attached by suitable fasteners such as rivets or nuts and bolts.

The yoke 50 engages the leg support 42 and is attached to the shoe platform 14. To prevent twisting of the leg support in the yoke, in a preferred embodiment, a key 200 closely engages a depression 202 in the yoke and/or a depression 204 the leg support.

In a preferred embodiment, the yoke comprises a collar 206 that encircles and is keyed to the leg support. Preferably, the collar defines multiple parallel keyways 202', 202" alongside the leg support to permit rotational adjustment of the leg support with respect to the collar by positioning the key in a different one of the keyways. Vertical adjustment of the leg support and the positioning of the calf brace on the user is preferably provided by forming the leg support as a telescoping unit. Preferably, the leg support defines a generally longitudinally extending close-ended key seat (depression 204) alongside the collar to limit longitudinal shifting of the key and the key is positioned in the key seat of the upright and in one of the open-ended keyways of the collar to resist twisting of the leg support in the collar.

In a further preferred embodiment of the invention, the yoke further comprises a channel bracket 220 having a bottom wall 222 extending between a pair of opposed preferably parallel sidewalls 224, 226. The bottom wall of the channel bracket is attached to the shoe platform such as by a bolt 234. The opposed sidewalls include a pair of preferably parallel ears 228, 230 extending away from the bottom wall. Each of the ears defines a slot 232.

The collar preferably further defines a protruding boss portion 236 that is received between the pair of ears of the channel bracket. The protruding boss defines a borehole 239 that is in alignment with the slots in the ears of the channel bracket. The yoke further comprises a bolt 238 passing through the slots in the ears of the channel bracket and through the borehole in the protruding boss portion of the collar. The protruding boss portion further defines a pair of recessed seats 240, 242 for closely locating the ears of the channel bracket against the recessed seats of the boss when the bolt 238 is fastened.

Preferably, the collar is one-piece, having a pair of parallel tabs 244, 246 extending away from the boss. A second bolt 248 is used to urge the tabs together to clamp the leg support at a location between the tabs and the boss.

The forward and rearward vertical support members 16 and 18 are preferably of telescoping construction to permit the stilts to be adjusted in length for working on overheads of different heights. In the prior art, each of the vertical supports is telescoping and is fixed in height by a bolt such as wing head bolt 250 positioned through a set of adjustment holes formed in each of the supports. In accordance with a further embodiment of the invention, a second bolt or pin 252 such as a wing head or knob head bolt is positioned through a second set of adjustment holes 254, 254' formed in each of the forward and rearward supports.

In a preferred embodiment, each of the vertical supports is formed from a pair of tubings of rectangular, preferably square, cross section telescoped together and having alignable sets of adjustment holes. The vertical supports are telescoped together as an inner tubing 251 and an outer tubing 253 and the outer tubing of each support leg defines two pairs of aligned holes. One hole of each of the two pairs of holes carries an attached nut 256, 256' for accepting a threaded end of one of the wing or knob head bolts. The inner tubing of each of the forward or rearward legs defines at least three pairs of aligned holes at a longitudinal spacing that is equal to the spacing between the pair of aligned holes in the outer tubing.

While certain preferred embodiments of the invention have been described herein, the invention is not to be construed as being so limited, except to the extent that such limitations are found in the claims.

What is claimed is:

1. A stilt comprising:

a floor platform;

a shoe platform;

a pair of substantially vertically mounted supports pivotally connecting the floor platform and the shoe platform, wherein the vertically mounted supports are spring biased to maintain the vertical supports and the platforms in a parallelogram configuration;

a leg support mounted to a mounting having a capturing bracket for engaging the lower end of the leg support and a yoke for engaging the leg support, wherein the mounting is configured to mount the leg support to one of the vertically mounted supports and to the shoe platform, and wherein the mounting is attached to the shoe platform; and a longitudinally extending key configured to closely engage either a longitudinally extending depression in the yoke or a longitudinally extending depression in the leg support, to resist twisting of the leg support with respect to the yoke.

2. A stilt comprising:

a floor platform;

a shoe platform;

a pair of substantially vertically mounted supports pivotally connecting the floor platform and the shoe platform, wherein the vertically mounted supports are spring biased to maintain the vertical supports and the platforms in a parallelogram configuration;

a leg support mounted to a mounting having a capturing bracket for engaging the lower end of the leg support and a yoke for engaging the leg support, wherein the mounting is configured to mount the leg support to one of the vertically mounted supports and to the shoe platform, and wherein the mounting is attached to the shoe platform; and a key, wherein the yoke comprises a collar that encircles the leg support and defines multiple parallel keyways extending longitudinally alongside the leg support, and wherein the collar is keyed to a longitudinally extending key seat formed in the leg support, by the key being positioned longitudinally in one of multiple parallel keyways of the collar and engaging the key seat to permit rotational adjustment of the leg support with respect to the collar.

3. A stilt as in claim 2, wherein the upright has a generally longitudinally extending key seat alongside the collar and the key is configured to be positioned in the key seat and in one of the keyways to resist twisting of the leg support in the collar.

4. A stilt comprising:

a floor platform;

a shoe platform;

a pair of substantially vertically mounted supports pivotally connecting the floor platform and the shoe platform, wherein the vertically mounted supports are spring biased to maintain the vertical supports and the platforms in a parallelogram configuration;

a leg support mounted to a mounting having a capturing bracket for engaging the lower end of the leg support and a yoke for engaging the leg support, wherein the mounting is configured to mount the leg support to one of the vertically mounted supports and to the shoe platform, and wherein the mounting is attached to the shoe platform; and a key configured to closely engage a depression in the yoke or a depression in the leg support, to resist twisting of the leg support with respect to the yoke, wherein the yoke comprises a collar that encircles the leg support and has multiple, longitudinally extending, parallel keyways, wherein the key is configured to engage a depression in the leg support and is positioned in one of the keyways to permit rotational adjustment of the leg support with respect to the collar, and wherein the yoke further comprises a channel bracket having a bottom wall attached to the shoe platform and extending between a pair of opposed sidewalls, wherein the opposed sidewalls include a pair of ears, each ear extending away from the bottom wall and defining a slot.

5. A stilt as in claim 4, wherein the collar further comprises a protruding boss that is received between the pair of ears of the channel bracket and has a borehole configured for alignment with the slots in the ears of the channel bracket, wherein the yoke further comprises a bolt passing through the slots in the ears of the channel bracket and through the borehole of the protruding boss, and wherein the protruding boss has a pair of recessed seats for closely locating the ears of the channel bracket against the protruding boss when the bolt is fastened.

6. A stilt as in claim 5, wherein the collar comprises a single piece having a pair of parallel tabs extending away from the protruding boss, and wherein the yoke further comprises a second bolt configured to urge the tabs together to clamp the leg support between the tabs and the protruding boss.

* * * * *